United States Patent [19]

Ito et al.

[11] Patent Number: 4,968,471

[45] Date of Patent: Nov. 6, 1990

[54] SOLUTION SPINNING PROCESS

[75] Inventors: Masayoshi Ito, Toride, Japan; Ming-Ya Tang; Soojaa L. Kim, both of Akron, Ohio

[73] Assignee: The Goodyear Tire & Rubber Company, Akron, Ohio

[21] Appl. No.: 242,589

[22] Filed: Sep. 12, 1988

[51] Int. Cl.[5] ..... D01F 6/62; D01D 5/06

[52] U.S. Cl. ..... 264/184; 264/203; 264/210.7; 264/210.8; 264/211.15; 264/211.16

[58] Field of Search ..... 264/210.8, 210.6, 210.7, 264/205, 184, 203, 211.15, 211.16

[56] References Cited

U.S. PATENT DOCUMENTS

| | | | |
|---|---|---|---|
| 2,743,250 | 4/1956 | Sweet et al. | 264/205 |
| 4,003,974 | 1/1977 | Chantry et al. | 264/210.8 |
| 4,413,110 | 11/1983 | Kavesh et al. | 264/205 |
| 4,755,587 | 7/1988 | Rinehart | 528/272 |
| 4,792,573 | 12/1988 | Cohn | 521/604 |

FOREIGN PATENT DOCUMENTS

| | | |
|---|---|---|
| 0077590 | 4/1983 | European Pat. Off. . |
| 0146084 | 6/1986 | European Pat. Off. . |
| 0251313 | 4/1988 | European Pat. Off. . |
| 61207615 | 3/1985 | Japan . |
| 61-207616 | 9/1986 | Japan . |
| 62-30024 | 2/1987 | Japan . |

*Primary Examiner*—Hubert C. Lorin
*Attorney, Agent, or Firm*—Alvin T. Rockhill

[57] ABSTRACT

This invention discloses a process for producing a high modulus, high tenacity polyethylene terephthalate filament which comprises (1) spinning a solution of polyethylene terephthalate in an organic solvent through a die to produce a solution spun filament, wherein the polyethylene terephthalate has an intrinsic viscosity of at least about 3.0 dl/g and wherein the organic solvent is selected form the group consisting of (a) hexafluoroisopropanol, (b) trifluoroacetic acid, (c) mixed solvent systems containing from about 20 weight percent to about 99 weight percent hexafluoroisopropanol and from about 1 weight percent to about 80 weight percent dichloromethane, and (d) mixed solvent systems containing from about 20 weight percent to about 99 weight percent trifluoroacetic acid and from about 1 to about 80 weight percent dichloromethane; and (2) subsequently drawing the solution spun filament to a total draw ratio of at least about 7:1 to produce the high modulus, high tenacity polyethylene terephthalate filament. The filaments made by the process of this invention have better thermal stability, such as a lower thermal shrinkage and a higher melting point, than fibers made utilizing standard melt processing techniques.

15 Claims, No Drawings

SOLUTION SPINNING PROCESS

BACKGROUND OF THE INVENTION

Polyethylene terephthalate filaments and yarns are utilized in a wide variety of applications. For instance, polyethylene terephthalate (PET) is commonly used in manufacturing high modulus industrial yarns. It is generally desirable for such industrial yarns to have the highest modulus and highest strength possible. This is because such yarns are utilized in making reinforcing elements for various products, such as tires, belts and hoses, where high strength and high modulus is beneficial.

The filaments utilized in making industrial yarns are typically made by melt spinning. In such procedures the melt spun filaments are subsequently drawn and thermally treated to enhance mechanical properties, such as modulus and strength. The PET utilized in commercial melt spinning procedures has conventionally had an intrinsic viscosity of less than about 1.1 dl/g. Until recently the possibility of utilizing PET having higher intrinsic viscosity was not a viable option. This was simply because viable commercial sources for PET having such high intrinsic viscosities were not available. However, recent advances in the art of preparing PET have made sources of PET having intrinsic viscosities of greater than 3.0 dl/g a viable option. However, standard melt spinning techniques cannot beneficially utilize ultra-high molecular weight PET having an intrinsic viscosity of greater than about 3.0 dl/g.

SUMMARY OF THE INVENTION

This invention discloses a technique for utilizing ultra-high molecular weight PET in preparing filaments for utilization in industrial yarn having exceptionally high modulus and strength. The PET utilized in the process of this invention has an intrinsic viscosity of at least about 2.5 dl/g. The procedure revealed involves spinning a solution of PET in an organic solvent through a die to produce a solution spun filament and subsequently drawing the solution spun filament to produce the high modulus, high strength PET filaments of this invention. It is important for the PET to be essentially homogeneously dispersed throughout the organic solvent. Even though many types of solvent systems are known to be capable of dissolving PET, only very specific solvent systems can be utilized in conjunction with the process of this invention. For example, suitable solvents for dissolving PET include nitro-benzene, acetonapthone, hexafluoroacetone, meta-cresol, nitrobenzene/tetrachloroethane mixed solvent systems, hexafluoroisopropanol/chloroform mixed solvent systems, tetrachloroethane/phenol mixed solvent systems, dichloroacetic acid, phenyl ether, and biphenyl. The organic solvents which can be utilized in conjunction with the process of this invention include hexafluoroisopropanol, trifluoroacetic acid, mixtures of hexafluoroisopropanol with dichloromethane, and mixtures of trifluoroacetic acid with dichloromethane.

This invention more specifically reveals a process for producing a high modulus polyethylene terephthalate filament which comprises (1) spinning a solution of polyethylene terephthalate in an organic solvent through a die to produce a solution spun filament, wherein the Polyethylene terephthalate has an intrinsic viscosity of at least 3.0 dl/g and wherein the organic solvent is selected from the group consisting of (a) hexafluoroisopropanol, (b) trifluoroacetic acid, (c) mixed solvent systems containing from about Z0 weight percent to about 99 weight percent hexafluoroisopropanol and from about 1 weight percent to about 80 weight percent dichloromethane, and (d) mixed solvent systems containing from about 20 weight percent to about 99 weight percent trifluoroacetic acid and from about 1 to about 80 weight percent dichloromethane; and (2) subsequently drawing the solution spun filament to a total draw ratio of at least about 7:1 to produce the high modulus polyethylene terephthalate filament.

Detailed Description of the Invention

The PET utilized in the process of this invention is typically comprised of repeat units which are derived from terephthalic acid or a diester thereof and ethylene glycol or a diester thereof. For instance, the PET utilized in the process of this invention can be prepared by polymerizing terephthalic acid with ethylene glycol or by polymerizing dimethyl terephthalate with ethylene glycol. Accordingly, the PET can be PET homopolymer which is comprised of repeat units which are derived only from terephthalic acid or a diester thereof and ethylene glycol or a diester thereof. The PET utilized in the process of this invention can optionally be a modified PET. Such modified PET can contain small amounts of repeat units which are derived from diacids other than terephthalic acid and/or glycol in addition to ethylene glycol. For instance, small amounts of isophthalic acid or a naphthalene dicarboxylic acid can be used in the diacid component utilized in preparing the PET. PET which has been modified with a small amount of diol containing from 3 to about 8 carbon atoms is also representative of a modified PET which can be utilized. For instance, a small amount of 1,4-butane diol can be utilized in the glycol component used in preparing the modified PET. Normally, no more than about 5 weight percent of the repeat units in such modified PET will be comprised of diacids or diols other than terephthalic acid and ethylene glycol. It is, of course, contemplated that diesters of such dicarboxylic acids and diols can also be used. In most cases, such modified PET will contain less than about 3% diacids other than terephthalic acid and less than 3% diols other than ethylene glycol. More typically, such modified polyesters will contain less than about 1% dicarboxylic acids other than terephthalic acid and/or less than 1% glycols other than ethylene glycol. In any case, PET homopolymer is an excellent choice for utilization in the process of this invention.

It is typically preferred for the PET to have an intrinsic viscosity (IV) of at least about 3 dl/g. For practical reasons, the PET will generally have an IV which is within the range of about 3.0 dl/g to about 10.0 dl/g. It is generally preferred for the PET utilized in the process of this invention to have an IV which is within the range of about 3.5 dl/g to about 6.0 dl/g. The intrinsic viscosities referred to herein are measured in a 60:40 percent by weight phenol:tetrachloroethane solvent system at a temperature of 30° C. and at a concentration of 0.4 g/dl. However, ultra-high molecular weight PET is not typically soluble in phenol/tetrachloroethane mixed solvent systems. Accordingly, in some cases it is necessary to measure the IV of the PET in a 50:50 percent by weight trifluoroacetic acid:methylene dichloride (dichloromethane) mixed solvent system. In cases where trifluoroacetic acid/dichloromethane mixed solvent systems were used to measure the IV of the ultra-high molecular weight PET, the IV reported was adjusted to conform to IV's as measured in 60:40 percent by weight phenol:tetrachloroethane solvent systems at 30° C.

The ultra-high molecular weight PET utilized in the process of this invention can be made utilizing the procedure described by Rinehart in U.S. Pat. No. 4,755,587 or the process described by Cohn in U.S. Pat. No. 4,792,573. The teachings of U.S. Pat. No. 4,755,587 and U.S. Pat. No. 4,792,573 are incorporated herein by reference in their entirety.

In the solution spinning process of this invention, a solution of PET in an appropriate organic solvent is prepared. It is important for the PET to be essentially homogeneously dispersed throughout the solvent. The organic solvents which can be utilized are selected from the group consisting of (a) hexafluoroisopropanol, (b) trifluoroacetic acid, (c) mixed solvent systems containing hexafluoroisopropanol and dichloromethane, and (d) mixed solvent systems containing trifluoroacetic acid and dichloromethane. The mixed solvent systems of hexafluoroisopropanol and dichloromethane will typically contain from about 20 weight percent to about 99 weight percent hexafluoroisopropanol and from about 1 weight percent to about 80 weight percent dichloromethane. Such hexafluoroisopropanol/dichloromethane mixed solvent systems will preferably contain from about 30 weight percent to about 99 weight percent hexafluoroisopropanol and from about 1 weight percent to about 70 weight percent dichloromethane. The mixed solvent systems containing trifluoroacetic acid and dichloromethane will typically contain from about 20 weight percent to about 99 weight percent trifluoroacetic acid and from about 1 weight percent to about 80 weight percent dichloromethane. Such trifluoroacetic acid/dichloromethane mixed solvent systems will preferably contain from about 25 weight percent to about 75 weight percent trifluoroacetic acid and from about 25 weight percent to about 75 weight percent dichloromethane. Solutions of PET in the organic solvent system can be prepared by simply mixing the PET throughout the solvent. This mixing procedure is typically carried out at room temperature which, for purposes of this patent application, is considered to be from about 15° C. to about 30° C. However, the temperature at which the solution is prepared is not very critical and solutions can normally be made at temperatures which are within the range of about 0° C. to about 60° C. if polymer degradation is kept to a minimum. The amount of PET dissolved into the organic solvent system can vary widely. As a general rule, the minimum concentration of PET needed decreases with increasing intrinsic viscosities of the PET. Suitable solutions of PET in trifluoroacetic acid containing solvent systems will typically contain from about 2 weight percent to about 70 weight percent PET, based upon the total weight of the solution. Such trifluoroacetic acid containing solvent systems will more typically contain from about 5 weight percent to about 30 weight percent PET and will preferably contain from about 7 weight percent to about 25 weight percent PET. Solutions made utilizing hexafluoroisopropanol containing solvent systems will typically contain from about 1 weight percent to about 50 weight percent PET. Such solutions which are prepared utilizing hexafluoroisopropanol containing solvent systems will more typically contain from about 3 weight percent to about 50 weight percent PET and will preferably contain from about 5 weight percent to about 30 weight percent PET.

Solution spun filaments are made by spinning a solution of PET in the organic solvent through a die. The solution spun filament is made by forcing the organic solvent containing the PET through the orifice of the die. The orifice of the die will typically be round, but can also be of other desired geometries. Dies have orifices of varied shape can be utilized to produce filaments having a wide variety of cross sectional designs, for example, round, square, rectangular, or elliptical. For instance, a die having a rectangular orifice can be utilized to produce a filament which is essentially in the form of a film. It is generally convenient to utilize a die having an orifice which is essentially circular. The orifice of such dies will typically have a diameter which is within the range of about 30 to about 400 microns. In most cases, it is preferred for such orifices to have a diameter which is within the range of about 40 microns to about 200 microns. Spinnerettes which are equipped with multiple holes can be used in manufacturing multifilament yarns.

The PET solution is forced through the die at a rate which is sufficient to attain a spinning speed of about 1 meter per minute to about 1000 meters per minute. It is generally more typical for the spinning speed to be within the range of about 2 meters per minute to about 400 meters per minute. It is desirable to utilize the fastest possible spinning speed which does not result in unsatisfactory uniformity. Higher spinning speeds are also desirable because they result in higher throughputs and better productivity. For this reason, spinning speeds in excess of 1000 meters per minute would be desirable if uniformity and other desired properties can be maintained.

The PET solution will be forced through the die utilizing an adequate pressure to realize the spinning speed desired. The pressure utilized with single orifice dies will typically be within the range of about 30 atmospheres to about 2,000 atmospheres. The pressure utilized in forcing the PET solution through the die will more typically be within the range of about 50 atmospheres to about 1,500 atmospheres. In cases where spinnerettes for making multifilament yarns are utilized, pressures will need to be adjusted accordingly. The PET solution will typically be solution spun into the solution spun filament at a temperature which is within the range of about 0° C. to about 60° C. Higher temperatures can be utilized if polymer degradation can be kept to a minimum. The solution spinning process will preferably be conducted at a temperature which is within the range of about 15° C. to about 30° C. This solution spinning process does not result in a substantial amount of thermally induced crystallization. The solution spinning process results in the production of solution spun filaments which may contain oriented polymer chains and some degree of crystallinity. Any crystallization which results from the solution spinning process is essentially stress induced.

Ideally the organic solvent utilized should be removed from the solution spun filament prior to drawing. Removal of the organic solvent system minimizes the amount of chain relaxation which can occur and accordingly helps to maintain chain orientation. It is particularly important to remove solvent from the solution spun filament prior to drawing at elevated temperatures. This is because the presence of solvent at elevated temperatures can result in polymer degradation. It is less critical to remove solvent from the solution spun filament prior to drawing at room temperature. It is desirable to remove the solvent utilized prior to the drawing procedure which is done at elevated temperatures. It is normally desirable for no more than about 5 weight percent of the organic solvent to be present in the solution spun filament during the drawing at elevated temperatures. It is typically preferably for the amount of organic solvent present in the solution spun filament to be reduced to less than about 2 weight percent prior to the drawing procedure.

The solution spun filament can be made utilizing dry spinning, dry jet-wet spinning or wet spinning techniques. Dry jet-wet spinning is preferred over wet spinning in cases where trifluoroacetic acid containing solvent systems are utilized. The organic solvent can be partially removed from the solution spun filament by spinning the solution spun filament from the die into a coagulating medium. To get optimal results, there will be an air gap in the dry jet-wet spinning of at least about 0.5 mm. Normally, the air gap will be 1 mm to 300 mm long. The coagulating medium used can be water. Mixtures of water with low boiling solvents which are miscible with dichloromethane and water can also be used. For example, water/acetone mixtures can be utilized as the coagulating medium. Such water/acetone mixtures will typically contain from about 70 weight percent to about 99 weight percent water and from about 1 weight percent to about 30 weight percent acetone. The utilization of such water/acetone mixtures may be advantageous because the presence of acetone in the coagulating medium helps to more readily remove dichloromethane from the organic solvent system. In any case it is highly desirable to frequently or continuously resupply the coagulating medium to keep the amount of trifluoroacetic acid, hexafluoroisopropanol and/or dichloromethane therein low. In cases where water is utilized as the coagulating medium, this can be done by continuously feeding clean water into the coagulating medium and simultaneously removing water containing organic solvents from the coagulating medium. By keeping the coagulating medium relatively free of solvents for the PET, the residence time in the coagulating medium can be minimized. The coagulating medium should be selected to attain a rate of coagulation which results in uniform structure (minimal skin-core structure) with minimum void content. In cases where dry spinning techniques are utilized, the solvent can be removed by air drying followed by vacuum drying or air drying followed by treatment in an appropriate solvent, such as water, acetone or methanol and subsequently again air drying and then vacuum drying.

After the solution spun filament has been prepared and preferably after solvent removal, it is subjected to a drawing procedure. During the drawing procedure the solution spun filament is drawn to a total draw ratio of at least about 7:1. The total draw ratio will typically be within the range of about 7:1 to about 15:1. More typically the total draw ratio utilized will be within the range of about 8:1 to about 12:1. It is advantageous to utilize relatively high draw ratios to maximize the tensile strength and modulus of the PET filament being produced.

The drawing procedure .can be carried out in a single drawing stage or preferably in multiple stages. In cases where hexafluoroisopropanol containing solvent systems are utilized, the first drawing stage is carried out at a temperature ranging from room temperature to about 80° C. In most cases it will be preferred for such a drawing step to be carried out at room temperature. The draw ratio utilized in such a first stage drawing step will vary with the drawing temperature utilized. However, the draw ratio utilized in the first stage will normally be no more than about 7:1. In most cases it will be preferred for the draw ratio utilized in the first stage to be within the range of about 4:1 to about 6:1. It is highly advantageous to carry out subsequent drawing stages at elevated temperatures. For instance, in cases where hexafluoroisopropanol containing solvent systems are utilized, the second stage draw will typically be carried out at a temperature which is within the range of about 65° C. to about 230° C. Such second stage drawing procedures will preferably be carried out at a temperature which is within the range of about 80° C. to about 220° C. and will more preferably be conducted at a temperature which is within the range of about 190° C. to about 210° C. Such elevated temperatures allow for a maximum rate of thermally induced crystallization which is desirable during the drawing procedure. Additional drawing steps can also be utilized to attain the desired total draw ratio.

In cases where trifluoroacetic acid containing solvent systems are utilized, it is desirable to carry out the first stage draw at a temperature which is within the range of room temperature to about 120° C. When trifluoroacetic acid containing solvent systems are utilized, it is more typical for the first stage draw to be carried out at a temperature which is within the range of about 15° C. to about 100° C. For instance, temperatures within the range of about 70° C. to about 90° C. are very acceptable. Such first stage drawing steps which are conducted at room temperature will normally not utilize draw ratios of higher than about 7:1. However, slightly higher draw ratios in the first stage can be utilized at elevated drawing temperatures. It is highly desirable to use multiple drawing stages in cases where trifluoroacetic acid containing solvent systems are utilized. Such subsequent drawing steps are typically carried out at an elevated temperature which is within the range of about 120° C. to about 240° C. The temperature utilized in second stage drawing steps will preferably be within the range of about 180° C. to about 230° C. and the draw ratio utilized will typically be within the range of about 1.2:1 to about 4:1. In cases where third stage drawing steps are utilized, the drawing temperature will preferably be within the range of about 210° C. to about 240° C. The draw ratio utilized in such optional third stage drawing procedures will typically be within the range of about 1.1:1 to about 1.15:1.

This invention is illustrated by the following examples which are merely for the purpose of illustration and are not to be regarded as limiting the scope of the invention or the manner in which it can be practiced. Unless specifically indicated otherwise, all parts and percentages are given by weight.

Examples 1–28

In this series of experiments, PET solutions in trifluoroacetic acid/dichloromethane solvent systems were spun into solution spun filament which was subsequently drawn to produce high modulus PET filament. The trifluoroacetic acid/dichloromethane solvent system utilized in this series of experiments contained 50 weight percent trifluoroacetic acid and 50 weight percent dichloromethane. In the experiments carried out, ultra-high molecular weight PET and the solvent were weighed into an Erylenmeyer flask. The flask was then placed on a shaker and agitated for over 12 hours. The intrinsic viscosity of the ultra-high molecular weight PET and the concentration of the solutions prepared in each of the experiments carried out is indicated in Table I. The solutions were transferred to a cylinder which was 0.95 cm in diameter and 10 cm long. It was equipped with a capillary which was 200 microns in diameter. The solution was pushed through the die with a piston at a constant rate which is indicated as the spinning speed in Table I. The extrudate formed (the solution spun filament) was coagulated by a dry jet-wet spinning process by passing the solution spun filament into a water bath which was located 5 mm below the spinning die in Examples 1, 2 and 28 and 10 mm below the spinning die in Examples 3–27. In this series of experiments, the coagulant was maintained at a temperature of about 25° C. In Examples 1–26 water was utilized as the coagulating medium. In Examples 27 and 28 a water/acetone solvent system was utilized as the coagulant. It contained 90% water and 10% acetone by volume. The gel spun filaments were continuously wound onto a spool having a diameter of 18 cm at a constant rate. The spools containing the solution spun filaments were then soaked in water for at least 2.5 hours and in most cases for at least 5 hours. The water bath was changed at least 4 times during the soaking procedure. The solution spun filaments on the spools were then dried typically by air drying following by vacuum drying at room temperature. The dried filaments were then continuously drawn utilizing the draw ratio and temperatures specified in Table I. This drawing was done by passing filaments over a heated surface with the draw being achieved by utilizing variable speed motors. The speed of the motors was adjusted to achieve the desired draw ratio. It should be noted that in some of the examples a single stage drawing procedure was utilized while in other procedures multiple step drawing procedures were utilized. The high modulus PET fibers made were then tested for tensile strength and modulus utilizing an Instron tensile tester Model 1122.

TABLE I

| Example | 1 | 2 | 3 | 4 | 5 | 6 | 7 |
|---|---|---|---|---|---|---|---|
| IV, dl/g | 4.67 | 4.67 | 3.77 | 3.77 | 3.77 | 3.77 | 3.77 |
| Concentration | 10.3 wt % | 10.3 wt % | 13.1 wt % | 13.1 wt % | 13.1 wt % | 13.1 wt % | 13.1 wt % |
| Spinning speed | 2.77 m/min | 2.77 m/min | 2.77 m/min | 2.77 m/min | 2.77 m/min | 2.77 m/min | 2.77 m/min |
| $Td_1$[a] | 80° C. | 80° C. | 80° C. | 80° C. | 80° C. | 80° C. | 80° C. |
| $DR_1$[b] | 5.01X | 4.40X | 5.02X | 4.73X | 4.73X | 5.02X | 5.02X |
| $Td_2$[c] | | 230° C. | | 210° C. | 195° C. | 210° C. | 210° C. |
| $DR_2$[d] | | 1.73X | | 1.64X | 1.71X | 1.49X | 1.47X |
| $Td_3$[e] | | | | | | | 240° C. |
| $DR_3$[f] | | | | | | | 1.15X |
| TDR[g] | 5.01X | 7.62X | 5.02X | 7.77X | 8.08X | 7.48X | 8.49X |
| Denier | 18.54 | 11.34 | 49.69 | 32.1 | 30.87 | 33.35 | 29.40 |
| Modulus (GPa) | 13.43 | 25.27 | 11.84 | 29.06 | 29.18 | 26.74 | 31.75 |
| Strength (GPa) | 0.39 | 0.97 | 0.57 | 1.31 | 1.22 | 1.15 | 1.37 |

| Example | 8 | 9 | 10 | 11 | 12 | 13 | 14 |
|---|---|---|---|---|---|---|---|
| IV, dl/g | 3.77 | 3.77 | 3.77 | 3.77 | 3.77 | 3.77 | 3.77 |
| Concentration | 13.1 wt % | 13.1 wt % | 13.1 wt % | 13.1 wt % | 13.1 wt % | 13.1 wt % | 13.1 wt % |
| Spinning speed | 2.77 m/min | 2.77 m/min | 2.77 m/min | 2.77 m/min | 2.77 m/min | 7.8 m/min | 7.8 m/min |
| $Td_1$[a] | 80° C. | 80° C. | 80° C. | 80° C. | 80° C. | 80° C. | 80° C. |
| $DR_1$[b] | 5.02X | 5.02X | 5.02X | 4.78X | 4.78X | 4.36X | 4.36X |
| $Td_2$[c] | 230° C. | 195° C. | 210° C. | | 200° C. | | 200° C. |
| $DR_2$[d] | 1.57X | 1.33X | 1.49X | | 1.61X | | 1.63X |
| $Td_3$[e] | | 240° C. | 230° C. | | | | |
| $DR_3$[f] | | 1.08X | 1.10X | | | | |
| TDR[g] | 7.86X | 7.21X | 8.25X | 4.78X | 7.49X | 4.36X | 7.12X |
| Denier | 49.69 | 34.60 | 30.25 | 59.93 | 37.26 | 20.71 | 17.68 |
| Modulus (GPa) | 30.53 | 28.82 | 30.89 | 10.87 | 26.62 | 10.74 | 27.96 |
| Strength (GPa) | 1.24 | 1.17 | 1.29 | 0.53 | 1.15 | 0.53 | 1.29 |

| Example | 15 | 16 | 17 | 18 | 19 | 20 | 21 |
|---|---|---|---|---|---|---|---|
| IV, dl/g | 3.77 | 3.77 | 3.77 | 3.77 | 3.77 | 3.77 | 3.77 |
| Concentration | 13.1 wt % | 13.1 wt % | 13.1 wt % | 13.1 wt % | 13.1 wt % | 15.3 wt % | 15.3 wt % |
| Spinning speed | 7.8 m/min | 2.77 m/min | 2.77 m/min | 7.8 m/min | 7.8 m/min | 2.77 m/min | 2.77 m/min |
| $Td_1$[a] | 80° C. | 80° C. | 80° C. | 80° C. | 80° C. | 80° C. | 80° C. |
| $DR_1$[b] | 4.36X | 4.48X | 4.48X | 4.48X | 4.48X | 4.86X | 4.86X |
| $Td_2$[c] | 210° C. | 210° C. | 240° C. | 220° C. | 230° C. | | 210° C. |
| $DR_2$[d] | 1.62X | 1.50X | 1.72X | 1.68X | 1.79X | | 1.69X |
| $Td_3$[e] | | 240° C. | | | | | |
| $DR_3$[f] | | 1.15X | | | | | |
| TDR[g] | 7.05X | 7.75X | 7.69X | 7.51X | 8.00X | 4.86X | 8.24X |
| Denier | 12.80 | 11.65 | 11.75 | 12.02 | 11.29 | 60.95 | 35.98 |
| Modulus (GPa) | 27.84 | 28.33 | 28.08 | 27.84 | 27.59 | 11.84 | 29.30 |
| Strength (GPa) | 1.29 | 1.31 | 1.29 | 1.28 | 1.27 | 0.60 | 1.37 |

| Example | 22 | 23 | 24 | 25 | 26 | 27 | 28 |
|---|---|---|---|---|---|---|---|
| IV, dl/g | 3.77 | 3.77 | 3.77 | 3.77 | 3.77 | 4.0 | 3.9 |
| Concentration | 15.3 wt % | 15.3 wt % | 15.3 wt % | 13.9 wt % | 13.9 wt % | 10 wt % | 7 wt % |
| Spinning speed | 2.77 m/min | 2.77 m/min | 2.77 m/min | 2.77 m/min | 2.77 m/min | 2.77 m/min | 2.77 m/min |
| $Td_1$[a] | 80° C. | 80° C. | 80° C. | 80° C. | 80° C. | Room Temp. | Room Temp. |
| $DR_1$[b] | 4.86X | 4.86X | 4.86X | 6.68X | 5.58X | 3–4X | 3–4X |
| $Td_2$[c] | 230° C. | 220° C. | 230° C. | | 210° C. | 230° C. | 230° C. |
| $DR_2$[d] | 1.78X | 1.80X | 1.97X | | 1.42X | | |
| $Td_3$[e] | | | | | | | |
| $DR_3$[f] | | | | | | | |
| TDR[g] | 8.66X | 8.76X | 9.59X | 6.68X | 7.94X | 10X | 10.3X |

TABLE I-continued

| | | | | | | | |
|---|---|---|---|---|---|---|---|
| Denier | 34.24 | 33.86 | 30.92 | 40.76 | 34.29 | 12.1 | |
| Modulus (GPa) | 32.48 | 34.43 | 42.37 | 20.63 | 27.35 | 26.74 | 29.30 |
| Strength (GPa) | 1.51 | 2.24 | 2.44 | 0.99 | 1.28 | 0.88 | 1.18 |

(a)Temperature of first draw.
(b)Draw ratio in the first stage.
(c)Temperature of second draw.
(d)Draw ratio in the second stage.
(e)Temperature in the third stage.
(f)Draw ratio in the third stage.
(g)Total draw ratio.

In Examples 7 and 9 shrinkage was determined to be 5.3% as measured in hot air at 177° C. without constraint. In Examples 6, 7, and 9, the filaments were determined to have melting points of 270° C., 272° C. and 274° C., respectively. A heating rate of 10° C./minute was utilized in determining melting points by differential scanning calorimetry. As can be seen by reviewing Table I, it is highly beneficial to utilize a multiple stage drawing procedure because higher modulus, tenacity, and improved thermal stability such as lower shrinkage and higher melting point are attained.

Example 29

In this procedure a mixed solvent system contain 50 weight percent hexafluoroisopropanol and 50 weight percent dichloromethane was utilized as the organic solvent for dissolving the ultra-high molecular weight PET. The ultra-high molecular weight PET utilized in this experiment had an intrinsic viscosity of 3.7 dl/g. A 10 weight percent solution of the PET in the hexafluoroisopropanol/dichloromethane mixed solvent system was prepared utilizing a dissolution temperature of 25° C. and a dissolution time of 100 minutes. The solution was prepared under a nitrogen atmosphere. A Z00 micron die was utilized in spinning the PET solution into a solution spun filament. The spinning was carried out at room temperature and the wet as-spun fibers produced were dried at 30° C. under vacuum. The PET filaments made utilizing this procedure were determined to have an intrinsic viscosity of 3.7 dl/g. Thus, an IV drop was not experienced during the solution spinning procedure. The PET fibers made were then drawn utilizing a two stage drawing procedure. determined that the PET filaments made had a modulus of 36 GPa and a tensile strength of 1.9 GPa. The tensile testing was done utilizing a tensile testing machine which was run utilizing a strain rate of 10-3/seconds. The cross sectional area of the drawn fibers or filaments produced was about $2\times10^{-4}$ mm$^2$.

Comparative Example 30

This experiment was conducted utilizing the basic procedure described in Example 29 except that nitrobenzene was utilized as the organic solvent for dissolving the PET and that the PET had an initial intrinsic viscosity of 4.2 dl/g. It was necessary to dissolve the PET in the nitrobenzene at a temperature of 185° to 210° C. This is because the PET would not dissolve in the nitrobenzene at room temperature. The high temperature required for dissolving the PET would, of course, be a major disadvantage to utilizing nitrobenzene as the organic solvent in commercial operations. In addition to this the nitrobenzene was not suitable as a solvent for the ultra-high molecular weight PET because its utilization resulted in the IV of the PET in the as-spun filament to drop to 2.6 dl/g. This is a intrinsic viscosity retention of only 62%. This is in great contrast to the utilization of the hexafluoroisopropanol/dichloromethane mixed solvent system which was utilized in Example 9 that resulted in an intrinsic viscosity retention of 100%.

In this procedure the spinning temperature utilized was 185° C., the first stage draw was conducted at room temperature, the second stage draw was conducted at 230° C., and a total draw ratio of 9:1 was used. The fiber produced had a modulus of only 25 GPa and a strength of only 0.9 GPa. Thus, the modulus and tensile strength of the filaments produced were greatly inferior to those of the filaments produced in Example 29 which utilized a hexafluoroisopropanol/dichloromethane mixed solvent system.

Comparative Example 31

In this experiment a standard melt spinning procedure was utilized to prepare melt spun filaments from a PET resin having an intrinsic viscosity of 1.04 dl/g. The fiber produced had a denier of 1,022, a tenacity of 0.93 GPa and a modulus of 12.13 GPa. This example clearly shows that the procedure of this invention leads to fibers which have much higher strength and modulus than can be prepared utilizing standard melt spinning procedures.

The shrinkage of the filaments produced was determined to be 19.3% as measured in hot air at 177° C. without constraint. This is much higher than the shrinkage which was observed in Examples 7 and 9. The melting point of the filament produced was determined to be 248° C.

Comparative Example 32

In this experiment an attempt was made to melt spin PET having an intrinsic viscosity of 4.67. However, the attempt was unsuccessful because it was not possible to spin the molten PET because of its very high melt viscosity. This example shows that it is not possible to benefit from the advantages of utilizing ultra-high molecular weight PET in making industrial fibers through conventional melt spinning procedures. The intrinsic viscosity of the extrudate was determined to be 0.98 dl/g.

Comparative Example 33

This experiment was conducted utilizing the general procedure described in Examples 1-28. In the procedure utilized, a 15 weight percent PET solution was prepared. The coagulant used was pure water. A single stage draw was utilized which applied a draw ratio of 7:1 and a drawing temperature of 240° C.. The filaments produced had a denier of 44.5, a tenacity of 0.42 GPa and a modulus of 10.26 GPa. This experiment shows that the use of PET having an intrinsic viscosity of only 2.4 dl/g is not desirable.

Comparative Example 34

The general procedure utilized in Examples 1–28 was repeated in this experiment except that the PET utilized had an intrinsic viscosity of 4.25 dl/g, a 10 weight percent PET solution was utilized, and acetone was used as the coagulant and as the washing medium. The solution spun filaments made by this procedure were opaque, porous and very weak. In fact, the fiber made was so weak that it was not possible to draw it. This experiment shows that it is not desirable to utilize acetone as the coagulant. This experiment shows that it is important to control the rate of coagulation to get desired results.

Comparative Example 35

The procedure utilized in Example 34 was repeated in this experiment except that the coagulant utilized was a 50%/50% water/acetone mixed solvent system and that water was utilized as the washing medium. In this experiment the solution spun filaments produced were opaque, porous and very weak. It was not possible to draw the solution spun filaments made. This experiment shows that it is not desirable to use coagulants which contain 50% more acetone.

Comparative Example 36

The general procedure utilized in Examples 1–28 was repeated in this experiment except that the PET had an intrinsic viscosity of 1.95 dl/g, a 5 weight percent solution was utilized, isobutyl alcohol was used as the coagulant and dichloroacetic acid was utilized as the solvent. It was necessary to utilize an elevated spinning temperature of 110° C. under a nitrogen atmosphere in order for the PET to be soluble in the dichloroacetic acid solvent. A continuous filament was not formed by this procedure and the intrinsic viscosity of the PET in the fibers dropped to 0.9 dl/g.

Comparative Example 37

The procedure utilized in Example 3 was repeated in this experiment except wet spinning was utilized in place of the dry jet-wet spinning technical used in Example 3. The extrudate from the die stuck to the die surface and did not form filaments. Thus, this experiment shows that wet spinning could not be used successfully.

While certain representative embodiments and details have been shown for the purpose of illustrating the subject invention, it will be apparent to those skilled in this art that various changes and modifications can be made therein without departing from the scope of the subject invention.

What is claimed is:

1. A process for producing a high modulus polyethylene terephthalate filament which comprises (1) spinning a solution of polyethylene terephthalate in an organic solvent through a die to produce a solution spun filament, wherein the polyethylene terephthalate has an intrinsic viscosity of at least about 3.0 dl/g and wherein the organic solvent is selected from the group consisting of (a) hexafluoroisopropanol, and (b) mixed solvent systems containing from about 20 weight percent to about 99 weight percent hexafluoroisopropanol and from about 1 weight percent to about 80 weight percent dichloromethane, wherein the organic solvent is removed from the solution spun filament by coagulation in a member selected from the group consisting of water and water/acetone systems; and (2) subsequently drawing the solution spun filament to a total draw ratio of at least about 7:1 to produce the high modulus polyethylene terephthalate filament.

2. A process as specified in claim 1 wherein the intrinsic viscosity of the polyethylene terephthalate is within the range of about 3.0 dl/g to about 10.0 dl/g.

3. A process as specified in claim 2 wherein the organic solvent is a mixed solvent system containing from about 20 weight percent to about 99 weight percent hexafluoroisopropanol and from about 1 weight percent to about 80 weight percent dichloromethane.

4. A process as specified in claim 3 wherein the polyethylene terephthalate has an intrinsic viscosity which is within the range of about 3.5 dl/g to about 6.0 dl/g.

5. A process as specified in claim 2 wherein the solution spun filament is drawn utilizing a multiple stage drawing procedure.

6. A process as specified in claim 5 wherein a first stage draw is carried out utilizing a draw ratio which is within the range of about 4:1 to about 6:1.

7. A process as specified in claim 6 wherein the first stage draw is conducted at a temperature which is within the range of about 15° C. to about 80° C.

8. A process as specified in claim 7 wherein a second stage draw is carried out at a temperature which is within the range of about 65° C. to about 230° C.

9. A process as specified in claim 2 wherein said die has an orifice having a diameter of about 30 microns to about 400 microns.

10. A process as specified in claim 2 wherein the solution spun filament is drawn to a total draw ratio which is within the range of about 7:1 to about 15:1.

11. A process as specified in claim 5 wherein the solution spun filament is drawn to a total draw ratio which is within the range of about 8:1 to about 12:1.

12. A process as specified in claim 2 wherein said organic solvent is a mixed solvent system containing from about 30 weight percent to about 99 weight percent hexafluoroisopropanol and from about 1 weight percent to about 70 weight percent dichloromethane.

13. A process for producing a high modulus polyethylene terephthalate filament which comprises (1) spinning a solution of polyethylene terephthalate in an organic solvent through a die to produce a solution spun filament, wherein the polyethylene terephthalate has an intrinsic viscosity of at least about 3.0 dl/g; wherein the organic solvent is a mixed solvent system containing from about 20 weight percent to about 99 weight percent trifluoroacetic acid and from about 1 to about 80 weight percent dichloromethane; wherein the organic solvent is removed from the solution spun filament by coagulation in a member selected from the group consisting of water and water/acetone systems; and wherein the solution spun filament is made by dry jet-wet spinning utilizing an air gap of at least 0.5 mm; and (2) subsequently drawing the solution spun filament to a total draw ratio of at least about 7:1 to produce the high modulus polyethylene terephthalate filament.

14. A process as specified in claim 13 wherein the PET has an intrinsic viscosity which is within the range of 3.5 dl/g to about 6.0 dl/g.

15. A process for producing a high modulus polyethylene terephthalate filament which comprises (1) spinning a solution of polyethylene terephthalate in an organic solvent through a die to produce a solution spun filament, wherein the polyethylene terephthalate has an intrinsic viscosity of at least about 3.0 dl/g and wherein the organic solvent is selected from the group consisting of (a) hexafluoroisopropanol and (b) mixed solvent systems containing from about 20 weight percent to about 99 weight percent hexafluoroisopropanol and from about 1 weight percent to about 80 weight percent dichloromethane, wherein the solution spun filament is made by wet spinning or dry-jet wet spinning; and (2) subsequently drawing the solution spun filament to a total draw ratio of at least about 7:1 to produce the high modulus polyethylene terephthalate filament.

* * * * *